US005762293A

United States Patent [19]

Crosbie

[11] Patent Number: 5,762,293

[45] Date of Patent: Jun. 9, 1998

[54] INFLATABLE KITE

[76] Inventor: Scott C. Crosbie, 4349 Brookside Ave., St. Louis Park, Minn. 55436

[21] Appl. No.: 855,962

[22] Filed: May 14, 1997

[51] Int. Cl.[6] ..... B64B 1/50; B64C 31/06; B63H 27/08; B60C 29/00

[52] U.S. Cl. ..... 244/33; 244/153 R; 244/155 R

[58] Field of Search ..... 244/33, 146, 153 R, 244/155 R, 155 A

[56] References Cited

U.S. PATENT DOCUMENTS

| | | | |
|---|---|---|---|
| D. 281,439 | 11/1985 | Jordan | D21/88 |
| 2,492,800 | 12/1949 | Isom | 244/31 |
| 3,317,165 | 5/1967 | Zobl, III | 244/155 |
| 3,335,985 | 8/1967 | Neal | 244/153 |
| 3,664,613 | 5/1972 | Johnston | 244/155 |
| 3,746,286 | 7/1973 | Christoffel | 244/155 A |
| 3,806,071 | 4/1974 | Brown | 244/153 R |
| 3,952,925 | 4/1976 | Laske | 244/153 R |
| 3,980,260 | 9/1976 | Laske | 244/153 R |
| 4,026,504 | 5/1977 | Christoffel, Jr. | 244/155 A |
| 4,029,273 | 6/1977 | Christoffel, Jr. | 244/153 R |
| 4,129,277 | 12/1978 | Jones et al. | 244/145 |
| 4,533,099 | 8/1985 | Stewart | 244/33 |
| 4,722,498 | 2/1988 | Cameron | 244/33 |
| 4,815,677 | 3/1989 | Rushing et al. | 244/33 |
| 4,919,365 | 4/1990 | Mears | 244/33 |
| 5,417,390 | 5/1995 | Southwick | 244/155 A |

*Primary Examiner*—Joseph Kaufman
*Assistant Examiner*—Virna Lissi Mojica
*Attorney, Agent, or Firm*—Palmatier, Sjoquist, Helget & Voigt, P.A.

[57] ABSTRACT

A two-piece inflatable kite is made from configured, mirror imaged top and bottom polyester films which are heat sealed about their peripheral edge. Integrally extending from the edges forwardly and rearwardly are string connecting tabs formed from the top and bottom films. The tabs support reinforced apertures for attaching the kite string bridle. The top and bottom film portions also form a valve for adding air into and out of an air tight compartment within the kite. The air tight compartment also forms the wings of the kite.

16 Claims, 5 Drawing Sheets

INFLATABLE KITE

BACKGROUND OF THE INVENTION

This application relates to an inflatable kite, and more particularly to an inflatable kite made from a lightweight, strong, no stretch, two-piece film.

Kite flying is well known to both the young and old. U.S. Pat. No. 3,317,165 illustrates a conventionally well known kite with a string connected to wooden bows over which is stretched paper, plastic or a fabric. U.S. Pat. No. 3,746,286 similarly illustrates a keel-type kite with a string being connected to a control rod which is next connected to a keel and to cross brace sticks in the wings of the kite.

Air foil type kites are also known. U.S. Pat. No. 3,806,071 shows an air foil kite made of a fabric with air pockets and without any type of a framework. Tabs have been added to the fabric along the body for engaging strings. U.S. Pat. No. 4,129,272 illustrates another inflatable flexible nylon air foil with strings attached to a spar along the front leading edge of the air foil. U.S. Pat. No. 5,417,390 illustrates a ram-air inflated kite of an air foil design made of nylon or polyester fabric with a complex array of string connections.

An early thermoplastic flexible plastic inflated kite is illustrated in U.S. Pat. No. 3,335,985. At the medial point of the kite body are located cloth and string patches which are bonded thereto for securing the kite to a kite string. U.S. Pat. No. 3,664,613 shows a polyethylene (EVA) inflatable kite with four point separate string connectors along the kite body. U.S. Pat. Nos. 3,952,575 and 3,980,260 illustrate an inflatable polyethylene kite with plastic cloth material bonded to the kite body for string attachment. U.S. Pat. No. 4,026,504 discloses an inflatable polyethylene kite with pressure sensitive adhesive secured string anchors, such as Tyvek, attached to the kite body. Lastly, Des. 281,439 illustrates an inflatable kite with a tail. A string attachment is located at the lower middle body portion.

The problems with these prior art inflatable kites are that they principally are not of a lightweight strong construction comparable to the invention disclosed herein. Their multi-part construction with their attached string holding patches or tabs easily tear off after repeated use. These inflatable kites are subject to damage upon the kite's landing or flying into a tree or some other structure. Further still, these prior art kites are subjected to high shear and laminar resistant air flow forces which will cause the materials to stretch. Stretching leads to warping and folding of key kite components which should remain rigid. Lastly, these prior art kites require complex manufacturing processes.

There is a need for a lightweight strong simple two-piece inflatable kite that will not be subject to stretching. The kite should have a long life meaning that the string anchors should not tear off of the kite nor should the kite be susceptible to puncturing. The wings and critical parts of the kite should remain rigid for a long life of continuous flying with no stretch qualities. Such a kite should be easy to manufacture by way of two roll-fed pieces passing between a heated platen apparatus which will simultaneously die cut the kite configuration thereout.

SUMMARY OF THE INVENTION

A two-piece inflatable kite is made from configured, mirror imaged top and bottom polyester films which are heat sealed about their peripheral edge. Integrally extending from the edges forwardly and rearwardly are string connecting tabs formed from the top and bottom films. The tabs support reinforced apertures for attaching the kite string bridle. The top and bottom film portions also form a valve for adding air into and out of an air tight compartment within the kite. The air tight compartment also forms the wings of the kite.

A principal object and advantage of the present invention is that the inflatable kite is of the most lightweight material known. All other thermoplastics, vinyls, nylons and fabrics are of a more heavy weight and do not so readily lend themselves to a kite construction that will fly in weak or moderate winds.

Another object and advantage of the present invention is that the polyester film material which makes up the two pieces of the kite which are heat sealed along their edges, is extremely strong. The string connecting tabs will not tear off of the kite under heavy winds and the kite will not be subject to puncturing upon the crashing of the kite or heavy winds and the kite will not be subject to puncturing upon the crashing of the kite or landing within trees or the like.

Another principal object and advantage of the present invention is that the polyester film does not stretch. With no stretching, the kite will not be subject to warping, folding or a drooping of the wings with continued use, as the kite will always maintain its inflated shape in a rigid condition.

Yet another object and advantage of the present invention is that the kite is easy to manufacture by the printing on one of two rolls, platen heat sealing along the configured edges and then dye cutting to create a completed inflatable kite ready for inflation and flying.

BRIEF DESCRIPTION OF THE DRAWINGS

FIG. 10 is a cross-sectional view partially broken away of the string connecting tab being reinforced by tape or the like;

DETAILED SPECIFICATION

Figure 1:
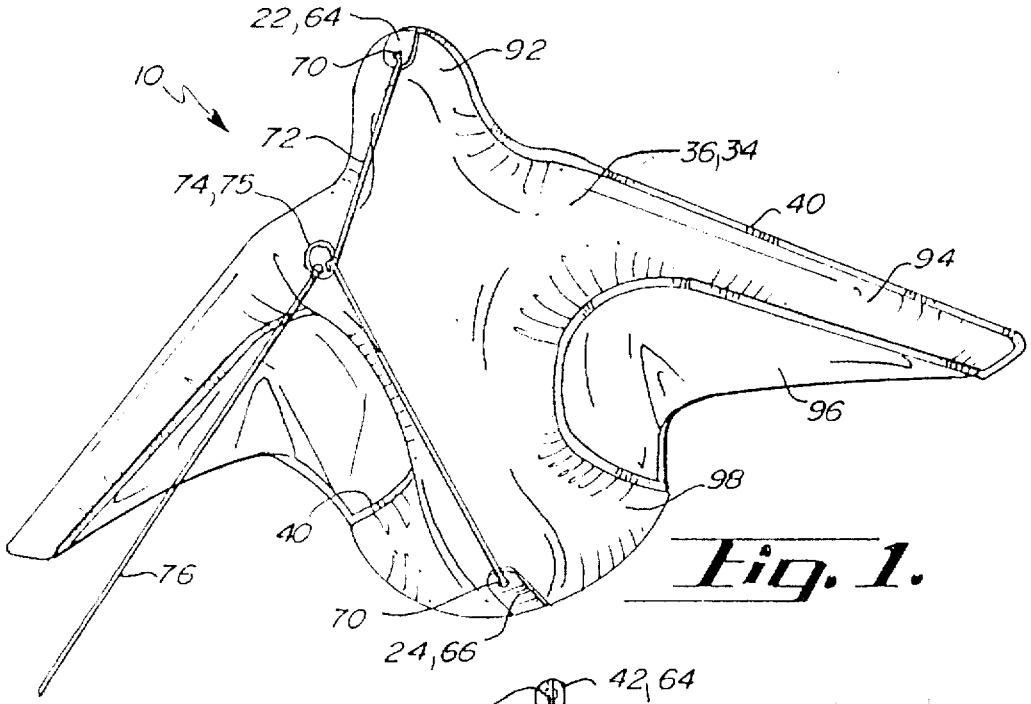
FIG. 1 is a perspective view of the inflatable kite of the present invention under flight.
Figure 2:
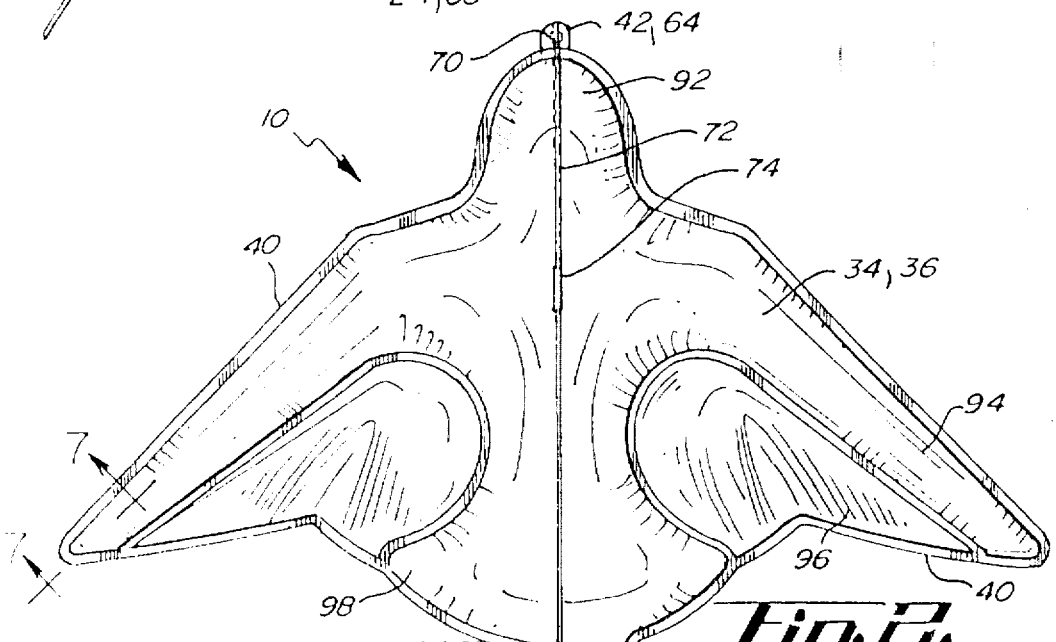
FIG. 2 is a bottom plan view of the inflatable kite.
Figure 3:
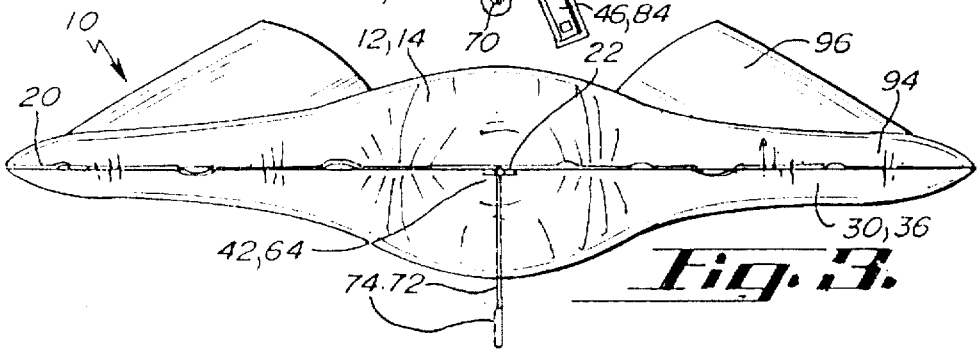
FIG. 3 is a front elevational view of the invention.
Figure 4:
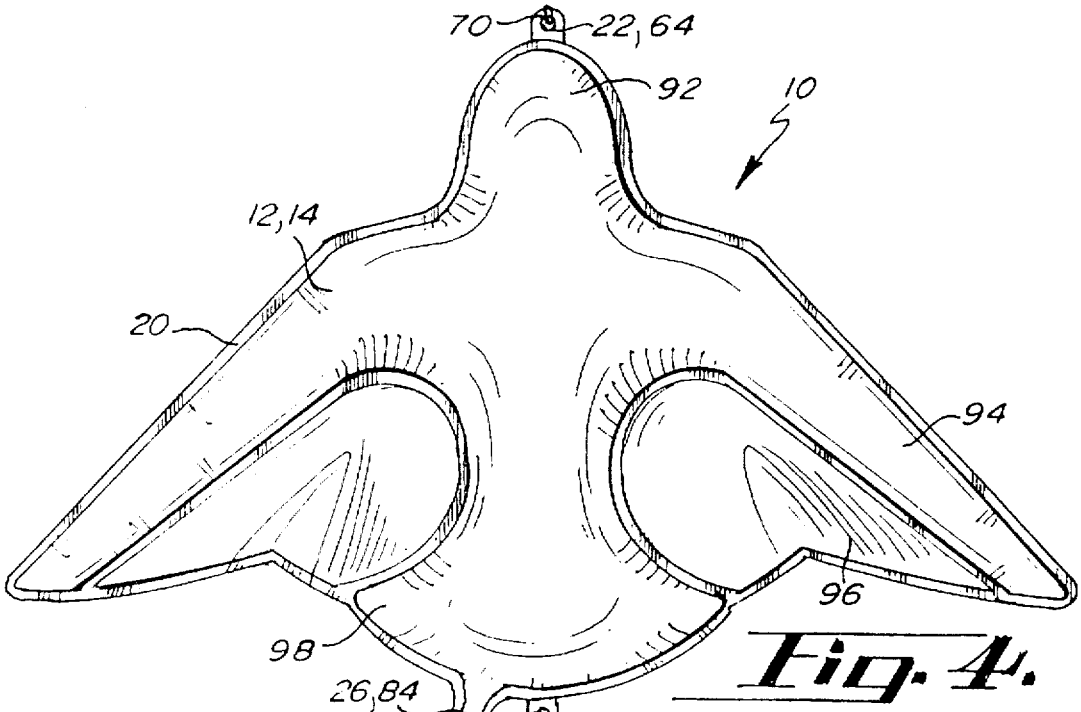
FIG. 4 is a top plan view of the inflatable kite.
Figure 5:
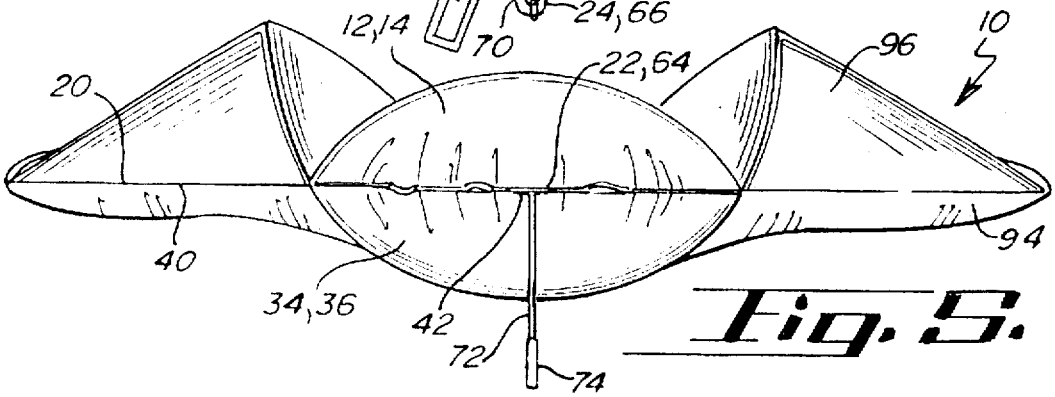
FIG. 5 is a rear elevational view of the inflatable kite.
Figure 6:
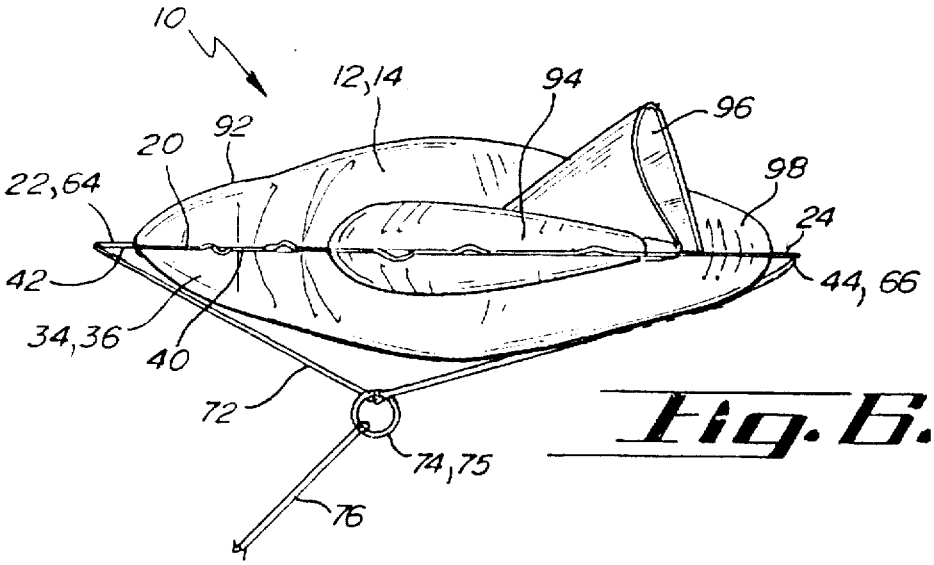
FIG. 6 is a side elevational view of the inflatable kite.

Referring to FIGS. 1–6, the inflatable kite 10 may generally be seen. The kite 10 has a top polyester film 12 and a bottom polyester film 34, both of which have their edges 20 and 40 fused into sealed edges 62. From the edges 62 protrude string connection tabs 64 and 66 which support apertures for tying the bridle 75 to the kite. The kite also has an inflation valve 84.

Again referring to FIGS. 1–6 and more specifically to 7–13, the construction of the inflatable kite 10 may be appreciated. The top polyester film 12 is configured into an aerodynamic structure such as a plane or bird. The polyester film 12 has an outer layer of aluminum coating 14 suitably placed thereon thereby known flashing or vacuum plating. On top of the aluminum coating 14, suitable printing 16 may be applied (see FIG. 14) such as by web or off-set printing. Inside the polyester film 12 is a polyvinylidene chloride (PVDC) layer 18. About the periphery of film 12 is edge 20. Protruding from a forward and rearward portions are integral string connecting top tabs 22 and 24. Also is a protruding integral top valve extending portion 26 having a slit 28 therein which will be appreciated later.

The bottom polyester film 34 is configured in a mere image of the top film 12. The bottom film 34 also has an outer aluminum layer 36 and an inside PVDC layer 38. Edge 40 is around the periphery of bottom film 34. Protruding from edge 40 is forward and rearward integral string connection tab portions 42 and 44 along with integral bottom valve extending portion 46.

Initially, the top polyester film 12 may be on a roll or web which may receive printing thereon by conventionally known means. Then the bottom polyester film 34 may similarly be on an aligned roll or web opposing the top film 12 and fed into a heated platen 60 and dye cut knife 61 apparatus.

Figure 7:
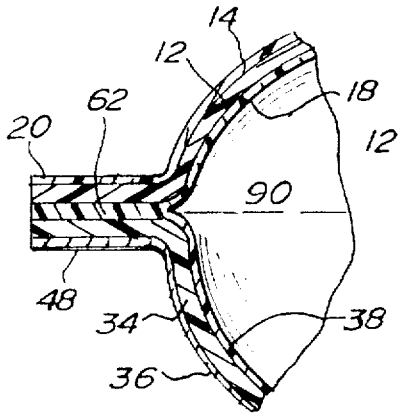
FIG. 7 is a cross-sectional view of an enlarged broken away view of the edge construction of the inflatable kite.
Figure 8:
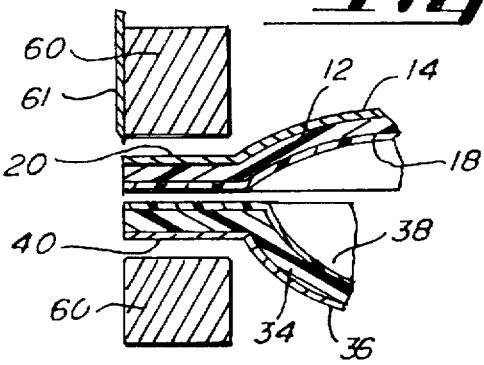
FIG. 8 is a cross-sectional diagramic side view of the heated platen and dye cut structure for forming the heat sealed edges of FIG. 7.
Figure 10:
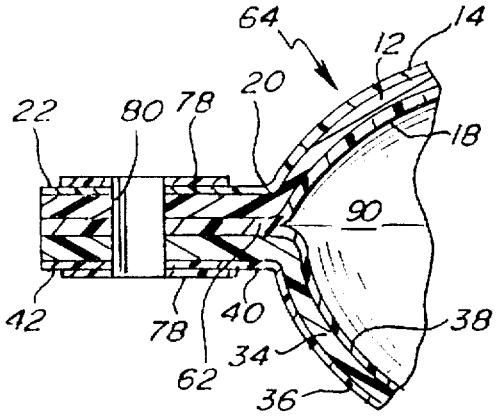
Figure 9:
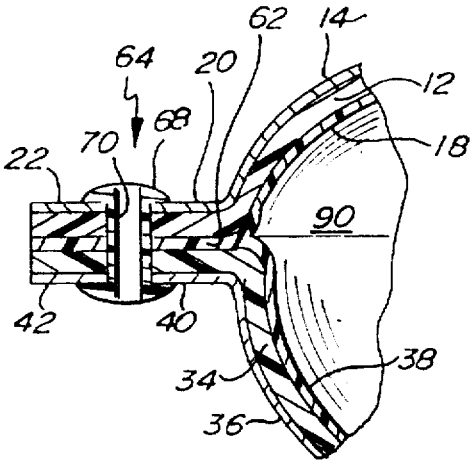
FIG. 9 is a cross-sectional view of the formed string connecting tabs with the aperture therethrough reinforced with a grommet.

The platen 60 creates the fused PVDC edges as shown in FIGS. 8 and 7 while the knife 61 configures the respective films 12 and 34 into the configured inflatable kite 10. Thus is also formed the forward integral string connecting tab 64 and the rearward integral string connecting tab 66.

Tabs 64 and 66 suitably may have a grommet 68 fitted therethrough creating aperture 70 which will receive a yolk string 72 which is connected to a ring 74 creating bridle 75. Alternatively, the connecting tabs 64 and 66 may have a reinforced tape 78 placed thereon and aperture 80 punched therethrough and the bridle 75 connected thereat.

Figure 11:
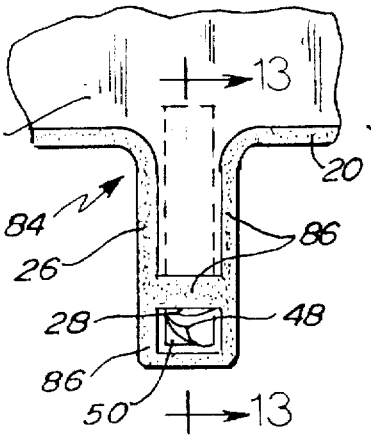
FIG. 11 is a top plan view partially broken away of the inflation valve of the kite.
Figure 13:
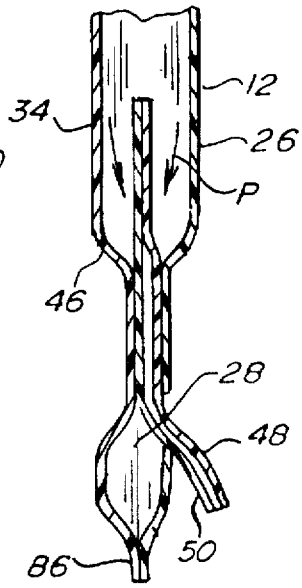
FIG. 13 is a cross-sectional view showing the valve sealing the air within the kite.
Figure 12:
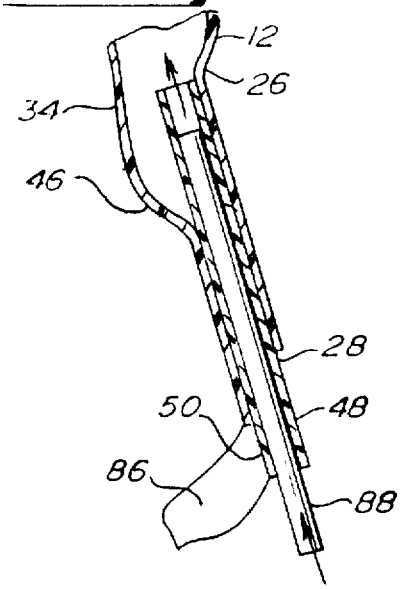
FIG. 12 is a cross-sectional view of the inflation valve inflating air into the kite.

With respect to the inflation valve 84 shown in FIGS. 11–13, the fused portions 86 seal the valve 84 with edges 62 excepting at the slit 28 and with respect to the plastic strips 48 and 50 which are of a higher melting temperature. By this arrangement, straw 88 may pass through the slit 28 and between strips 48 and 50 shown in FIG. 12. Arrow A shows the air into the air tight compartment 90 of the kite 10. Pressure arrows P show the pressure from within the compartment 90 which closes the strips 48 and 50 together into an air tight relationship to seal the kite.

Generally, the kite has a nose 92, wings 94, lift gussets 96 and a tail 98. The kite will readily fly after inflation by securement of the bridle 75 comprised of the yolk string 72 and ring 74 being connected to the respective tabs 64 and 66. The kite string 76 connected to ring 74 may be fed out by the individual flying the kite. The kite may simply be deflated after use by inserting the straw through slit 28 and in between strips 48 and 50 to allow the air to escape.

Figure 14:
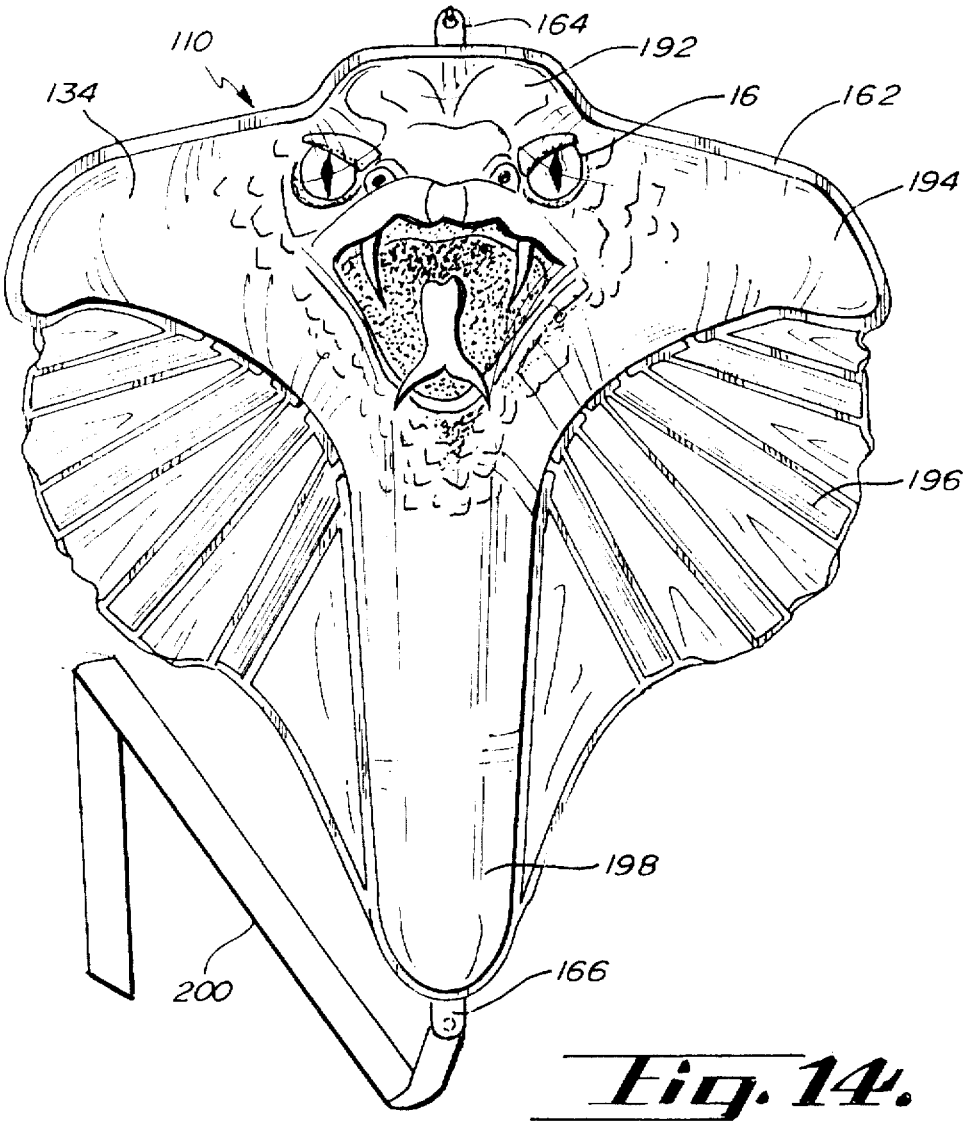
FIG. 14 is a second embodiment of the inflatable kite.
Figure 15:
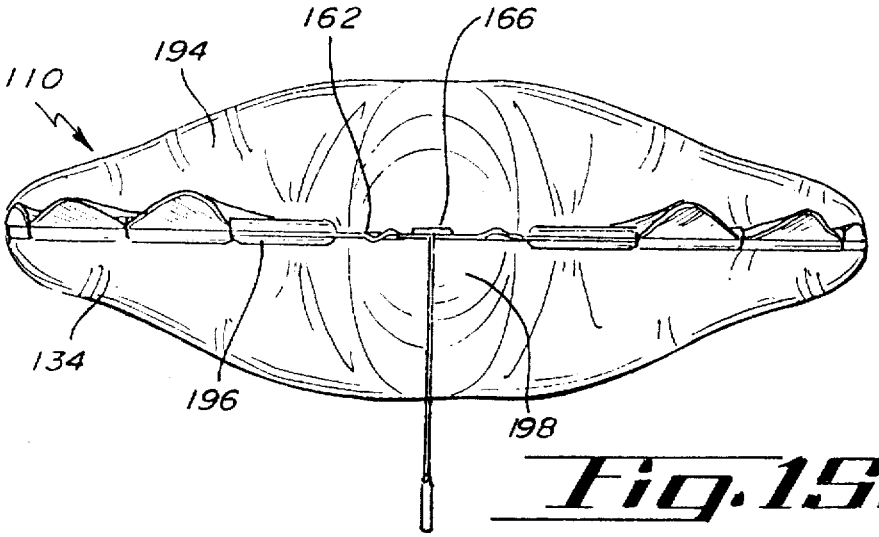
FIG. 15 is a rear elevational view of the second embodiment kite of FIG. 14.

Referring to FIGS. 14 and 15, a second kite embodiment 110 may be shown. The second embodiment 110 includes a top film 112, bottom film 134 which may receive printing 16. The sealed edges 162 are created around the periphery of films 112 and 134. Tabs 164 and 166 are also created as previously described for connecting the kite to a bridle and kite string. This second embodiment kite 110 also has a nose 192, wings 194, inflated wing gussets 196, tail and an optional tail attachment 200 for weighting of the kite when necessary.

Figure 16:
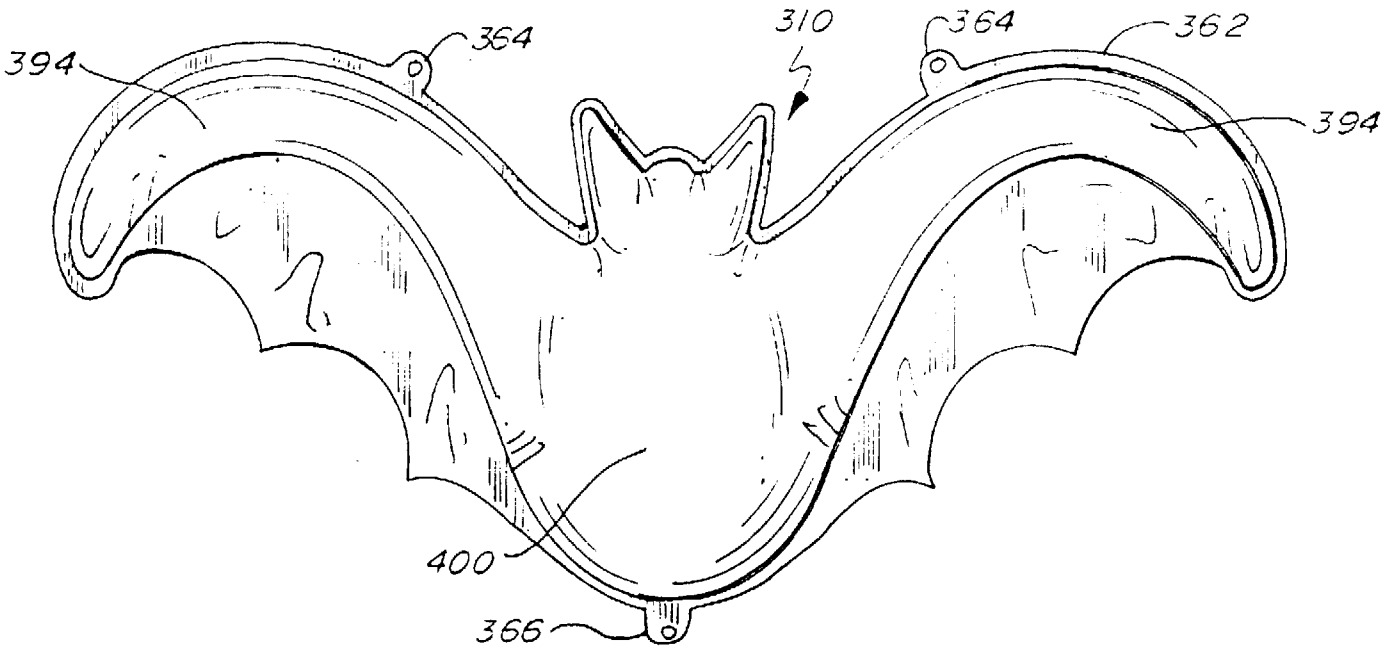
FIG. 16 is yet a third embodiment of the inflatable kite.

Referring to FIG. 16, yet a third embodiment of the kite 310 is shown. This version similarly has sealed edges 362, tabs 364 and 366, wings 394 and a body section 400. By the various embodiments 10, 110 and 310, it may be appreciated that the kite of the present invention may assume any of a variety of configurations.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

I claim:

1. An inflatable kite comprising (a) a configured top polyester film with an edge therearound, the edge having extending therefrom two integrally formed string connecting top tab portions and one integrally formed top valve portion; and (b) a mirror imaged configured bottom polyester film with another edge therearound, the bottom edge having extending therefrom two integrally formed string connecting bottom tab portions and one integrally formed bottom valve portion, wherein the edges, the string connecting tab portions and the valve portions are respectfully heat sealed together to create an air-tight compartment, wings, string connecting tabs and a valve.

2. The inflatable kite of claim 1, wherein the top and bottom films have an outer layer of aluminum thereon.

3. The inflatable kite of claim 1, wherein the top and bottom films have an inner layer of polyvinylidene chloride thereon which are fused together along the edges, tabs and valve portions.

4. The inflatable kite of claim 1, wherein the sealed together tab portions have an aperture therethrough for securing a string to the tab.

5. The inflatable kite of claim 4, wherein the apertures are reinforced against tearing.

6. The inflatable kite of claim 1, wherein the string connecting tab portions are along a forward edge portion and a rearward edge portion.

7. An inflatable kite comprising (a) a configured top polyester film with an edge therearound, the edge having extending therefrom two integrally formed string connecting top tab portions and one integrally formed top valve portion; and (b) a mirror imaged configured bottom polyester film with another edge therearound, the bottom edge having extending therefrom two integrally formed string connecting bottom tab portions and one integrally formed bottom valve portion wherein the edges, the string connecting tab portions and the valve portions are respectfully heat sealed together to create an air-tight compartment, wings, string connecting tabs and a valve, the films having an outer layer of aluminum thereon.

8. The inflatable kite of claim 7, wherein the top and bottom films have an inner layer of polyvinylidene chloride thereon which are fused together along the edges, tabs and valve portions.

9. The inflatable kite of claim 7, wherein the sealed together tab portions have an aperture therethrough for securing a string to the tab.

10. The inflatable kite of claim 9, wherein the apertures are reinforced against tearing.

11. The inflatable kite of claim 7, wherein the string connecting tab portions are along a forward edge portion and a rearward edge portion.

12. A two-piece inflatable kite comprising (a) a configured top polyester film with an edge therearound, the edge having extending therefrom two integrally formed string connecting top tab portions and one integrally formed top valve portion; and (b) a mirror imaged configured bottom polyester film, the films having an outer layer of aluminum thereon and an inner layer of polyvinylidene chloride thereon, the bottom film have another edge therearound having two integrally formed string connecting bottom tab portions and one integrally formed bottom valve portion, wherein the edges, the string connecting tab portions and the valve portions are respectfully heat sealed together by fusing the polyvinylidene chloride edge layers together to create an air-tight compartment, wings, string connecting tabs and a valve.

13. An inflatable kite of claim 12, wherein the sealed together tab portions have an aperture therethrough for securing a string to the tab.

14. An inflatable kite of claim 13, wherein the apertures are reinforced against tearing.

15. An inflatable kite of claim 12, wherein the string connecting tab portions are along a forward edge portion and a rearward edge portion.

16. An inflatable kite comprising (a) a configured top polyester film with an edge therearound, the edge having extending therefrom two integrally formed string connecting top tab portions and one integrally formed top valve portion;

(b) a mirror imaged configured bottom polyester film with another edge therearound, the bottom edge having extending therefrom two integrally formed string connecting bottom tab portions and one integrally formed bottom valve portion, wherein the edges, the string connecting tab portions and the valve portions are respectfully heat sealed together to create an air-tight compartment, wings, string connecting tabs and a valve; and (c) a bridle connected to the tabs for connecting the kite to a kite string.

* * * * *